US006280356B1

(12) United States Patent
Sandeen

(10) Patent No.: US 6,280,356 B1
(45) Date of Patent: Aug. 28, 2001

(54) BALL FEATURING RESILIENT RADIATING ARMS

(76) Inventor: Mike Sandeen, P.O. Box 343, Acampo, CA (US) 95220

( * ) Notice: Subject to any disclaimer, the term of this patent is extended or adjusted under 35 U.S.C. 154(b) by 0 days.

(21) Appl. No.: 09/358,147

(22) Filed: Jul. 19, 1999

(51) Int. Cl.[7] ..... A63B 37/14; A63B 43/02
(52) U.S. Cl. ..... 473/614
(58) Field of Search ..... 473/614, 596, 473/575, 576, 569, 280, 281

(56) References Cited

U.S. PATENT DOCUMENTS

| | | | | |
|---|---|---|---|---|
| 646,350 | | 3/1900 | Breinl . | |
| 1,548,531 | | 8/1925 | Knight . | |
| 2,213,013 | * | 8/1940 | Owen | 473/281 |
| 2,290,216 | | 7/1942 | Steinmetz et al. . | |
| 2,450,474 | | 10/1948 | Grobner . | |
| 2,789,305 | | 4/1957 | Weil . | |
| 3,069,170 | | 12/1962 | Dillon . | |
| 4,131,276 | | 12/1978 | Judkins . | |
| 4,149,723 | * | 4/1979 | Simon | 473/569 |
| 4,522,396 | | 6/1985 | Girard et al. . | |
| 4,756,529 | | 7/1988 | Stillinger . | |
| 4,884,807 | | 12/1989 | Welch . | |
| 4,927,141 | * | 5/1990 | Paranto | 473/413 |
| 4,962,926 | | 10/1990 | Chen . | |
| 4,991,841 | * | 2/1991 | Paranto | 473/614 |

FOREIGN PATENT DOCUMENTS

| | | | |
|---|---|---|---|
| 483502 | * | 5/1952 | (CA) . |
| 197808 | * | 8/1978 | (DE) . |

* cited by examiner

*Primary Examiner*—Steven Wong
(74) *Attorney, Agent, or Firm*—Heisler & Associates

(57) ABSTRACT

A ball 10 is provided which includes a plurality of arms 30 radiating from a core 20. The arms 30 are formed from a resilient material so that the arms 30 return to an original shape radiating away from the core 20 of the ball 10 when deforming loads are removed from the arms 30 of the ball 10. Tips 40 of the arms 30 define a peripheral contour 25 of the ball 10. Gaps 50 between the tips 40 define a greater portion of the peripheral contour 25 of the ball 10 than do the tips 40, such that fingers of a player can readily pass into the gaps 50 to grasp the arms 30 of the ball 10. The arms 30 can extend linearly away from the core 20 or can extend non-linearly, such as in a zig-zag or a wavy manner. A method for forming the ball 10 is disclosed where an initial sheet 60, with a series of slits 66 extending into lateral edges 64 of the sheet 60, is rolled into a spiral and bound with a tie 70 to form the ball 10.

4 Claims, 4 Drawing Sheets

BALL FEATURING RESILIENT RADIATING ARMS

FIELD OF THE INVENTION

The following invention relates to balls for recreation and/or the teaching of coordination and motor skills. More particularly, this invention relates to balls which include a series of resilient arms which radiate from a central core and methods for manufacturing such balls.

BACKGROUND OF THE INVENTION

Balls formed from soft and resilient lightweight materials are known in the art for providing amusement and for teaching coordination and motor skills while minimizing the risk of injury to players and damage to furniture and other structures where such balls are being used. Some such balls of various different shapes and sizes are formed of hydrocarbon foam material and are marketed under the trademark "NERF."

Some such soft and resilient balls are particularly characterized by having a plurality of soft flexible arms which radiate from a central core of the ball. For instance, U.S. Pat. No. 4,131,276 to Judkins teaches a non-injurious amusement ball which includes a series of foam strips having resilient characteristics with the foam strips bound together so that they extend radially from a core. The Judkins ball is particularly configured to have a periphery thereof defined by ends of the foam strips with relatively small gaps between the foam strips so that the ball has a relatively high density and stable trajectory. While effective for its purpose, the Judkins ball, having its relatively higher density, is not fully effective when utilized with young children or players with poorly developed coordination and motor skills. The Judkins ball can be both difficult to handle (i.e. catch and throw) and can be heavier than desired for its size, making the Judkins ball less than desirable in many circumstances.

U.S. Pat. No. 4,756,529 to Stillinger teaches a spherical object with floppy filaments that also fits within the general category of balls configured to have soft flexible arms radiating from a central core. While the Stillinger ball has many desirable characteristics, it is formed of filaments which are not resilient, but rather merely flexible/floppy, providing a ball which does not hold its shape when deformed. The Stillinger ball thus does not exhibit any form of bouncing characteristics and does not otherwise exhibit an ability to return to its original shape.

Accordingly, a need exists for a ball which includes resilient arms radiating from a central core which are sufficiently spaced so that gaps around the arms allow fingers of a player to reach in amongst the arms for secure capture and a ball which resiliently returns to its original shape when deforming loads are removed therefrom.

SUMMARY OF THE INVENTION

The ball of this invention beneficially provides a soft ball which includes resilient arms that can be easily grasped by a player and which maintain an original shape when not experiencing deforming loads. The ball includes a plurality of arms which radiate from a central core. The arms are formed from a resilient foam material, such as foam rubber or other hydrocarbon foam materials or similar materials, which can be deformed and yet return to their original shape when deforming loads are removed. The arms extend out to tips which define a portion of a peripheral contour of the ball. Gaps between adjacent tips define a greater portion of the peripheral contour than the tips themselves. Thus, fingers of a player's hands can easily pass in amongst the arms by passing through the gaps, allowing the player to easily grab the ball. In this way, players with a lesser degree of coordination and motor skills, particularly in their hands and arms, are more able to develop these skills and enjoy ball associated games than when playing with other prior art balls. The arms can radiate linearly or non-linearly in a zig-zag, wavy or other manner away from the core.

While the ball can be formed from a variety of different techniques, the preferred technique of this invention is to initially provide the ball as a sheet of the desired foam material which includes a series of slits extending to lateral edges between ends of the sheet. The slits extend only partway into the lateral edges of the sheet so that a spine which is free of slits is presented along a mid-portion of the sheet and extending between the ends of the sheet. The sheet is then rolled-up about an axis parallel to the ends of the sheet and a tie band is secured about the spine so that the spiral configuration of the sheet is maintained. The lateral edges of the sheet are not bound and so radiate away from the tie band. The resilient nature of the material forming the sheet causes the portions of the sheet between the slits to repel each other in a uniform manner such that they form the arms of the ball extending radially away from the core where the tie band is provided.

OBJECTS OF THE INVENTION

Accordingly, a primary object of the present invention is to provide a ball which has resilient arms radiating away from a core so that the ball can be easily grasped by hands of a player without requiring a high level of coordination or motor skills.

Another object of the present invention is to provide a ball which is lightweight and soft so that injury to players is avoided and damage to surrounding structures is avoided.

Another object of the present invention is to provide a ball which is formed from a resilient material such that the ball returns to an original shape when deforming loads are removed from the ball.

Another object of the present invention is to provide a ball which is sufficiently flexible so that it is easily grasped by hands of a player when the hands collapse upon and deform portions of the ball.

Another object of the present invention is to provide a ball with a unique appearance including a central core with arms radiating from the central core.

Another object of the present invention is to provide a ball which includes arms radiating from a central core which are spaced apart sufficiently so that fingers of a player can pass into gaps between the arms and securely grab the arms, such that a ball that is easy to catch, grasp and throw is provided.

Another object of the present invention is to provide a ball which can be easily manufactured to provide a plurality of arms radiating from a central core.

Another object of the present invention is to provide a ball which can provide enjoyment and act as a teaching tool for players which have poorly developed coordination and/or motor skills.

Other further objects of the present invention will become apparent from a careful reading of the included drawing figures, the claims and detailed description of the invention.

DESCRIPTION OF THE PREFERRED EMBODIMENT

Figure 2:
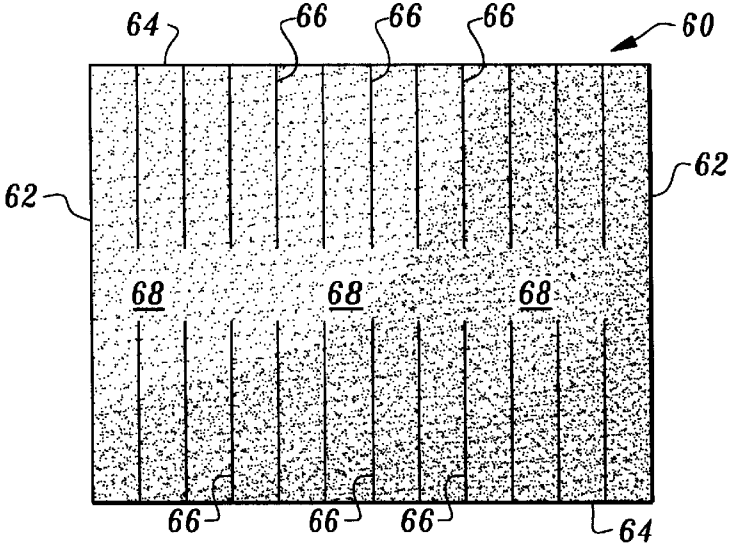
FIG. 2 is a top plan view of a sheet of material to be used in forming the ball of FIG. 1.
Figure 3:
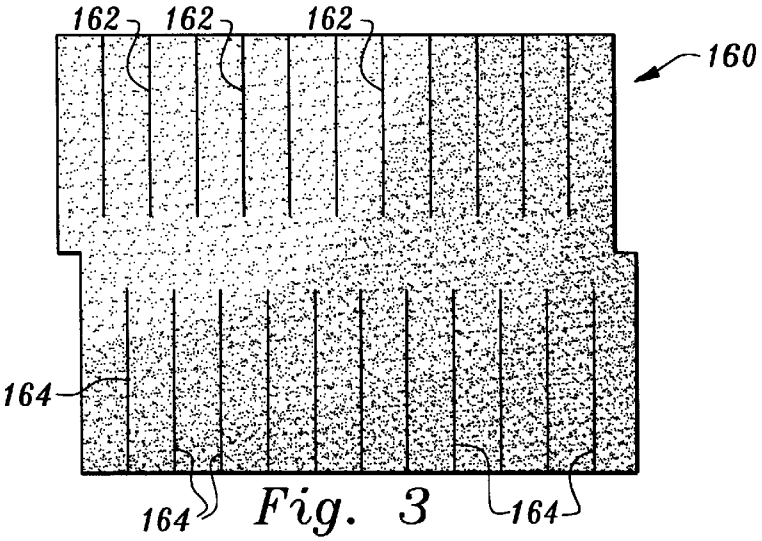
FIG. 3 is an alternative sheet for forming the ball of this invention where slits are offset.

Referring to the drawings wherein like reference numerals represent like parts throughout the various drawing figures, reference numeral 10 is directed to a ball which includes a plurality of arms 30 extending from a core 20 to tips 40. The arms 30 are formed from a soft resilient material so that the arms 30 return to an original position after deforming loads are removed. The tips 40, along with gaps 50 between the tips 40 of the arms 30 together define a peripheral contour 25 of the ball 10. The gaps 50 define a larger portion of the peripheral contour 25 of the ball 10 than do the tips 40 of the arms 30, so that fingers of a player can more easily pass between the arms 30 and into the gaps 50 for grasping the ball 10.

Figure 1:
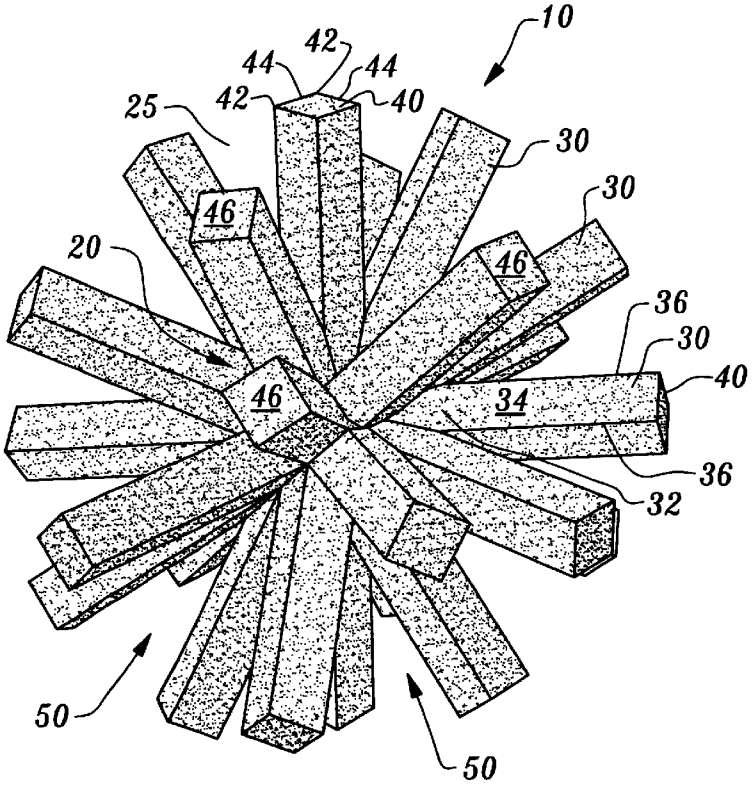
FIG. 1 is a perspective view of the ball of this invention after completion of a manufacturing process of this invention.
Figure 6:
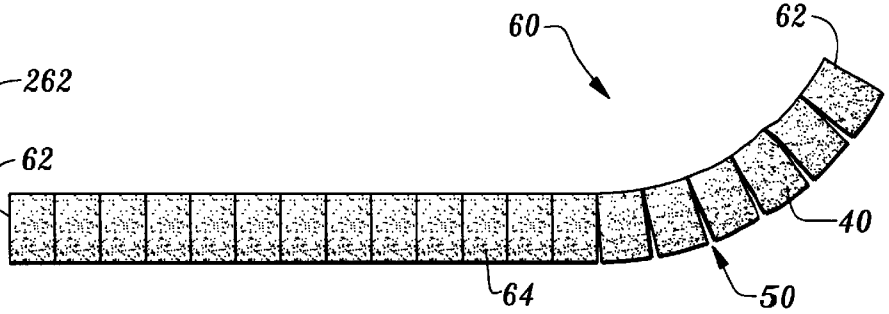
FIGS. 6 and 7 are front elevation views of that which is shown in FIG. 2 showing initial steps in the manufacturing process to form the ball of this invention.
Figure 7:
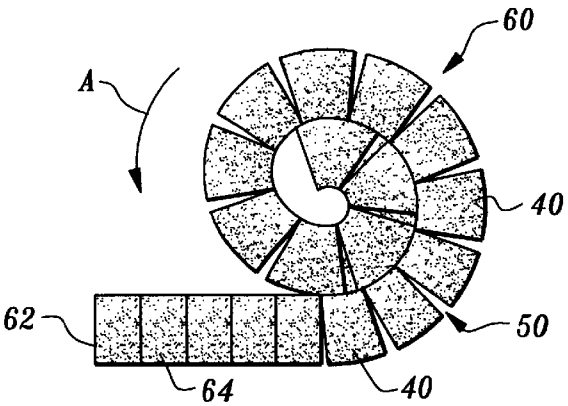
Figure 10:
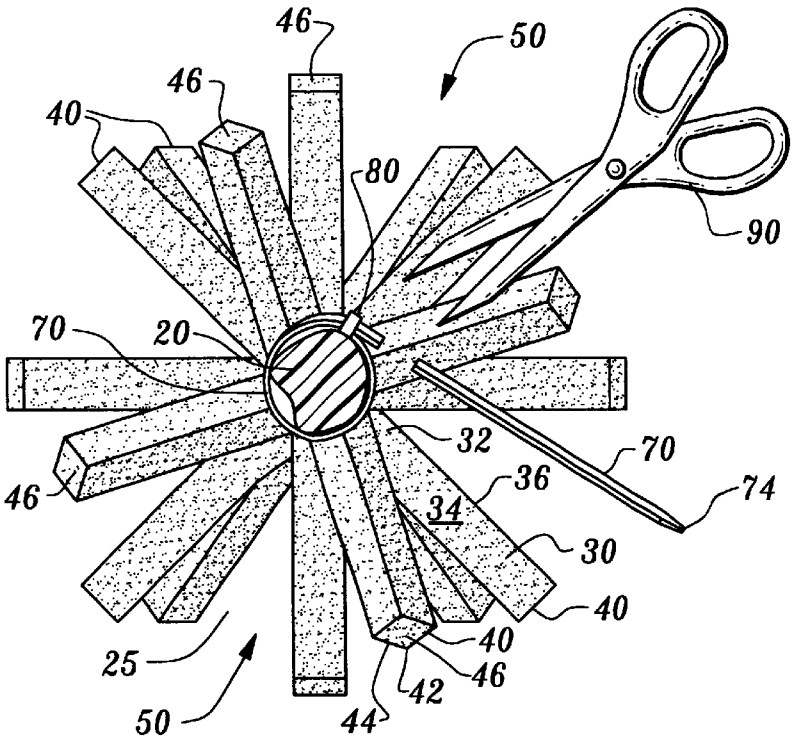
FIG. 10 is a full section of the ball of FIG. 1 revealing interior details of the core of the ball and showing the final step in the process of manufacturing the ball of this invention by tightening the tie band and severing excess portions of the tie.
Figure 9:
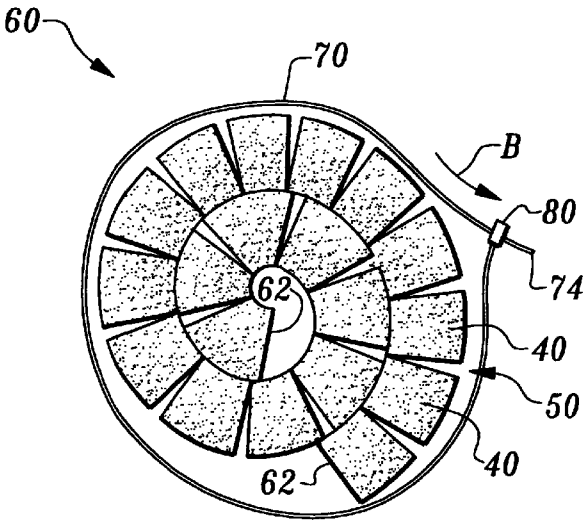
FIG. 9 is a front elevation view of the sheet of this invention after it has been rolled into a spiral and when the tie is being used to transform the sheet of this invention into the ball of this invention.
Figure 11:
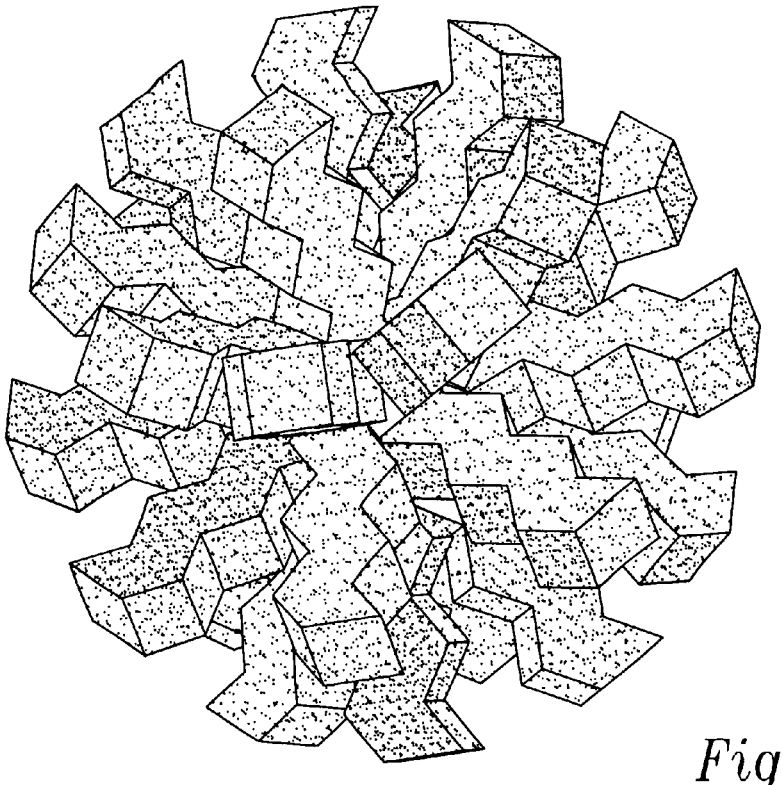
FIG. 11 is a perspective view of an alternative embodiment of that which is shown in FIG. 1 featuring zig-zag arms that result from manufacturing the ball from the sheet shown in FIG. 4.
Figure 12:
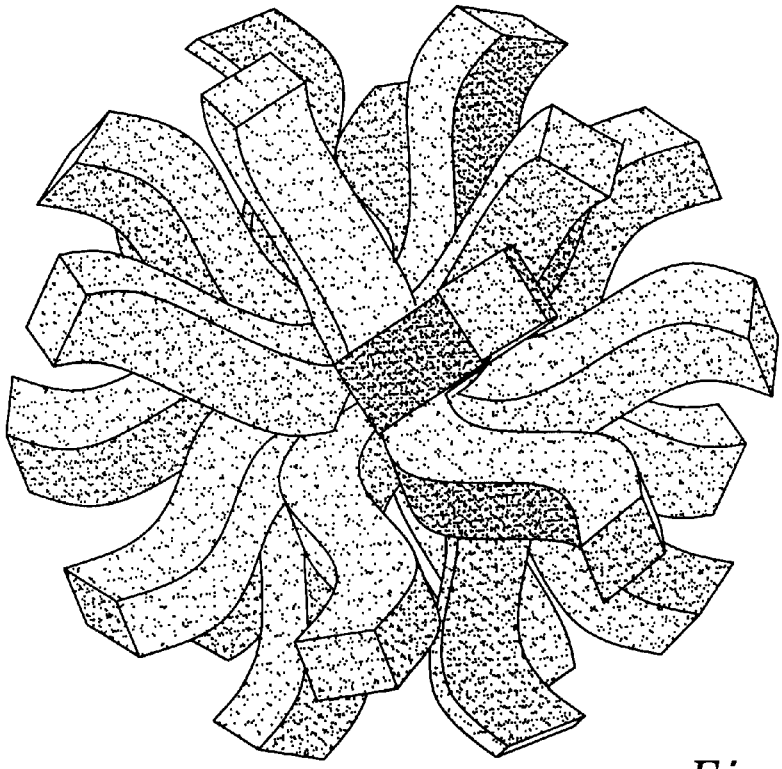
FIG. 12 is a perspective view of an alternative embodiment of that which is shown in FIG. 1 featuring wavy arms that result from manufacturing the ball from the sheet shown in FIG. 5.

More specifically, and with particular reference to FIGS. 1 and 10, the particular details of the structural configuration of the ball 10 are described. The arms 30, and preferably the entire ball 10, are formed from a resilient lightweight soft material which can be easily compressed and rapidly returns to its original form when deforming loads are released. This material is most preferably a cellular solid foam material formed from a hydrocarbon such as a type of rubber or other hydrocarbon material which can be readily configured as a cellular foam which has the desired lightweight and resilient characteristics. The term resilient is used to identify materials which are both flexible and elastic so that the material can be readily deformed and yet rapidly elastically returns to its original shape when deforming loads have been removed.

While the entire ball 10 is preferably formed from this appropriately lightweight, resilient material, it is only actually necessary that the arms 30 of the ball 10 be constructed with such resilient characteristics. Each arm 30 includes a base 32 where the arm 30 connects to the core 20 of the ball 10 and the tip 40 opposite the base 32. The arms 30 preferably include flat sides 34 extending between the base 32 and the tip 30 and edges 36 between the sides 34 of the arms 30. Preferably, the arms 30 are square or rectangular in cross-section with their cross-section remaining constant from the base 32 to the tip 40. Alternatively, the arms 30 could be circular in cross-section, have a variable cross-section or exhibit other geometric contours in cross-section as the arms 30 extend from the base 32 to the tip 40. The arms 30 are preferably linear, extending radially from the base 32 to the tip 40. However, as an acceptable alternative, the arms 30 can be configured to exhibit a zig-zag (FIG. 4) or wavy (FIG. 5) contour as the arms 30 extend from the base 32 to the tip 40.

The tip 40 of each arm 30 is preferably flat and square in form. Hence, each tip 40 includes four corners 42 between adjacent peripheral edges 44 which surround a surface 46 of the tip 40. The surface 46 thus defines a portion of a peripheral contour of the ball 10. Other portions of the peripheral contour 25 of the ball 10 are defined by gaps 50 between the tips 40 of the ball 10. The gaps 50 do not physically define the periphery 25 of the ball 10. Rather, the gaps 50 can be considered to define a portion of the peripheral contour 25 of the ball 10 by imagining a peripheral surface which extends away from the tips 40 of each arm 30 to adjacent tips 40 of adjacent arms 30 across the gaps 50. Such imaginary extensions of the tips 40 across the gaps 50 actually define the portions of each gap 50 which establish remaining portions of the periphery 25 which are not physically defined by the surface 46 of the tip 40 of each arm 30.

While the tips 40 preferably have a flat surface 46, it is an acceptable alternative that the tips 40 have other contours such as a curving contour, pointed contour or faceted contour. If the tips 40 have any contour other than the flat surface 46, the tips 40 still define the periphery 25 of the ball 10 in that they generally define the ends of the arms 30 opposite the core 20 so that such alternative tips generally define the periphery 25 of the ball 10.

To make the ball 10 as easy to grasp as possible, and to provide an attractive appearance, the gaps 50 between adjacent tips 40 preferably are larger than the tips 40 themselves. Hence, a majority of the periphery 25 of the ball 10 is defined by the gaps 50 and less than half of the periphery 25 of the ball 10 is defined by the tips 40 of the arms 30. For maximum benefit in allowing fingers of a player to extend into the gaps 50 and grasp the arms 30 of the ball 10, the tips 40 preferably define between 10% and 25% of the periphery 25 of the ball 10. However, many of the benefits of allowing fingers to pass into the gaps 50 between the tips 40 of the arms 30 are provided when the gaps 50 define at least a majority of the periphery 25 of the ball 10. These benefits generally increase as the gaps 50 define a greater percentage of the peripheral contour 25 of the ball 10 with the ball 10 becoming particularly easy to grasp when the gaps 50 define at least 75% of the peripheral contour 25 of the ball 10. These benefits begin to diminish when the gaps 50 define more than 90% of the peripheral contour 25 of the ball 10.

Preferably, the arms 30 of the ball 10 are each similar in length so that the tips 40 define the peripheral contour 25 of the ball 10 as a sphere. Alternatively, the arms 30 can be provided with varying lengths so that a ball 10 having a different peripheral contour 25 can be provided. For instance, if the arms 30 have random different lengths, an irregular sphere-like peripheral contour can be provided. If a pattern of longer and shorter arms 30 are provided, the ball 10 can have a peripheral contour such as an ovoid (i.e. such as a football or rugby ball) or appear to define the contour of a geometric shape (i.e. a tetrahedron).

The appearance of the ball 10 can be additionally modified by painting or otherwise coloring the tip surfaces 46 and sides 34 of the arms 30 of the ball 10 with different colors or in patterns which can provide the ball 10 with a desirable appearance.

With particular reference to FIGS. 2 and 6–10, details of a preferred method for manufacture of the ball 10 of this invention are described. This preferred method of manufacture is not the only method by which the ball 10 can be manufactured. Rather, this method of manufacture is merely one method of manufacture of the ball 10 which is currently preferred.

Initially, and with particular reference to FIG. 2, the ball 10 starts as a sheet 60 of the appropriate resilient material. The sheet 60 includes parallel ends 62 spaced from each other with parallel lateral edges 64 extending between the ends 62. Slits 66 extend into the lateral edges 64 parallel to each other and parallel to the ends 62. The slits 66 do not pass entirely through the sheet 60 between the lateral edges 64. Rather, the slits 66 most preferably extend only approximately 45% of a width of the sheet 60 into the lateral edges 64. Thus, approximately 10% of the distance between the lateral edges 64 of the sheet 60 is left without any slits 66 therein and defines a spine 68 of the sheet 60. Preferably, the slits 66 pass entirely between an upper and lower surface of the sheet 60 and a thickness of the sheet 60 between the upper and lower surfaces is similar to a distance between adjacent slits 66. In this way, the thickness of the sheet 60 and the distance between the slits 66 causes the arms 30 to have a square cross-section when the sheet 60 has been formed into the ball 10, as described below.

With reference to FIGS. 6–10, the ball 10 is then formed from the sheet 60 by rolling the sheet 60 up into a spiral. Specifically, the sheet 60 is rolled up about an axis parallel to the ends 62 of the sheet 60. One of the ends 62 forms a center of the spiral and the other of the ends 62 defines an outmost portion of the spiral. The sequence of forming the sheet 60 into a spiral is depicted in sequence by FIGS. 6, 7 and 9, with arrow A defining a direction of rotation of the sheet 60 to cause the sheet 60 to be rolled up into the spiral form. Once the sheet 60 has been rolled up into a spiral, it is necessary to provide a tie 70 to secure the sheet 60 and tighten the spiral of the sheet 60 to convert the sheet 60 into the ball 10 (FIG. 1).

Specifically, a tie 70 is provided which has an elongate flexible band 72 which extends from a tapering tip 74 at one end to a ring 80 at an opposite end. Ribs 76 are formed along the band 72 so that the band 72 has a variable thickness. The ring 80 includes an opening 82 which has a tooth 84 therein. The opening 82 is sized so that the band 72 can pass through the opening 82. However, the ribs 76 can only pass beyond the tooth 84 within the opening 82 by slightly resiliently deforming the tooth 84 and/or the ribs 76. Hence, as the band 72 is passed through the opening 82 and is continued to be pulled tight (along arrow B of FIG. 9) the tie 70 more and more tightly binds the sheet 60 to its spiral form. The ribs 76 and tooth 84 coact so that is easier to tighten the tie 70 than to loosen the tie 70.

After the tie 70 has been pulled sufficiently tight to provide a diameter of the tie 70 with a width substantially similar to a width of the arms 30 of the ball 10, tightening of the tie 70 is ceased. Portions of the band 72 beyond the opening 82 are then preferably removed with an appropriate cutting tool 90, such as scissors (FIG. 10). Because the portions of the sheet 60 between the slits 66 are compressed adjacent the spines 68, and because the material forming the sheet 60 is sufficiently resilient that the portions of the sheet 60 desire to be in a non-deformed state, the portions of the sheet 60 between the slits 66 naturally repel each other and hence radiate in a somewhat random pattern away from the spine 68 where the tie 70 binds the portions of the sheet 60 between the slit 66 together. Hence, these portions of the sheet 60 between the slits 66 become the arms 30 of the ball 10 extending radially away from the core 20 defined by the spine 68 and tie 70 portion of the sheet 60. Preferably, the material forming the sheet 60 is sufficiently resilient that the portions of the arm 30 close to the base 32 expand around and hide the tie 70 so that the tie 70 cannot be seen and the ball 20 takes on the desired appearance with the arms 30 extending radially away from the core 20.

To alter the appearance of the ball 10 somewhat, alternative embodiments of the sheet 60 can be provided. For instance, an alternative offset sheet 160 (FIG. 2) can be provided with left slits 162 and right slits 164 offset relative to each other. The alternative offset sheet 160 can potentially allow the ball 10 to be more tightly bound together with the tie 70 or other binding device and can otherwise provide a somewhat unique appearance and other benefits over that provided by the preferred sheet 60.

Figure 4:
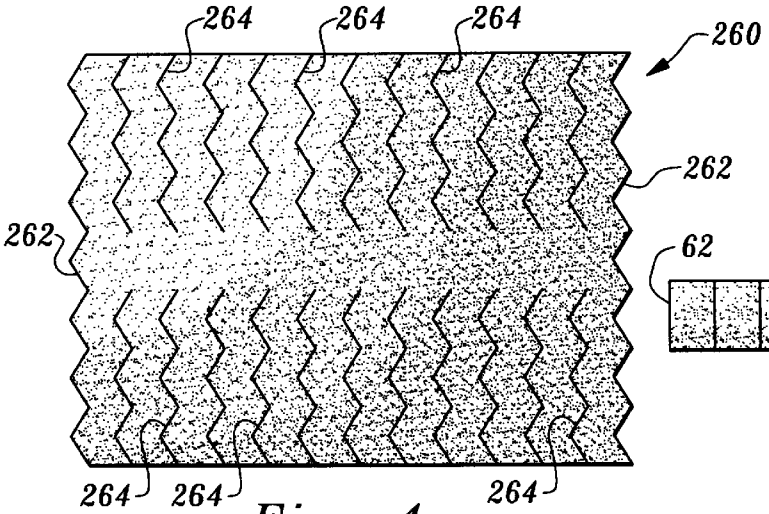
FIG. 4 is a top plan view of a second alternative configuration for the sheet of this invention where the slits follow a zig-zag pattern.

The sheet 60 can be replaced with a second alternative "zig-zag" sheet 260 which includes zig-zag ends 262 and zig-zag slits 264 (FIG. 4). The zig-zag sheet 260 can result in a ball which has arms which radiate away from the core in a zig-zag fashion rather than strictly radially. A unique appearance for the ball can thus be provided.

Figure 5:
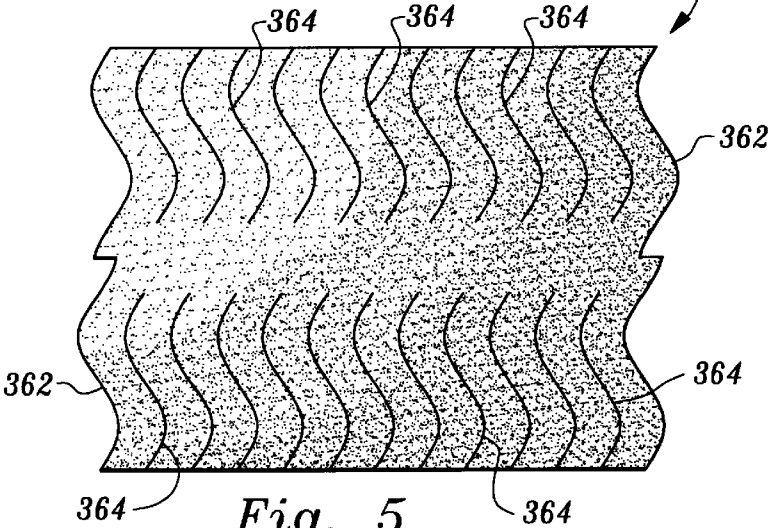
FIG. 5 is a to plan view of a third alternative configuration for the sheet of this invention where the slits follow a wavy pattern.
Figure 8:
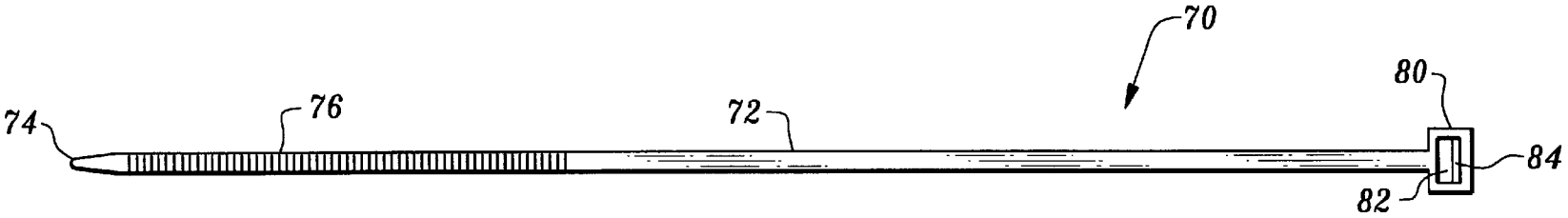
FIG. 8 is a top plan view of a binding tie of this invention to convert the sheet of this invention into the ball of this invention.

A third alternative wavy sheet 360 can be utilized which includes wavy ends 362 and wavy slits 364 (FIG. 5). As with the alternative zig-zag sheet 260, the alternative wavy sheet 360 can provide another ball with another unique appearance. The alternative zig-zag sheet 260 or the alternative wavy sheet 360 can be provided with either offset slits or with non-offset slits depending on the particular needs of the manufacturer of the ball and the particular appearance desired for the ball.

Once the ball 10 has been manufactured, it is ready for use by players and/or by teachers and students. Particularly, whenever any game is played which requires the use of a ball, such as catch, the ball 10 of this invention can conceivably be substituted. One particularly beneficial "game" which can be played with this ball 10 is to allow players with diminished coordination and/or motor skills to play catch more effectively. Not only is the ball 10 particularly soft and lightweight to allow it to be safely thrown with players having weak arms and poorly coordinated arms and fingers, but can also be more easily caught. Because the gaps 50 between adjacent arms 30 are large and because the arms 30 have a resilient characteristic, fingers of the player can easily pass into the gaps 50 when touching the ball 10 and are effectively lightly pinched and grabbed by the resilient material forming the arms 30 adjacent the sides 34 of the arms 30. Hence, the ball 10 can often be caught with little or no intentional movement of the fingers or arms of the player touching the ball 10. The ball 10 can thus be enjoyed by young children who have not yet developed good hand/eye coordination or children and adults which have poorly developed motor skills or coordination for a variety of different reasons. The balls 10 can additionally be enjoyed by players who have highly developed coordination and motor skills to play games that could otherwise be played with other types of balls with the potential variations in games to be played being essentially endless.

This disclosure is provided to reveal a preferred embodiment of the invention and a best mode for practicing the invention. Having thus described the invention in this way, it should be apparent that various different modifications can be made to the preferred embodiment without departing from the scope and spirit of this disclosure.

What is claimed is:

1. A ball, comprising in combination:

a plurality of elongate arms extending away from a central core;

at least one of said arms formed of a sufficiently resilient material that said at least one arm can be deformed away from an original shape and later automatically returned to said original shape;

said at least one arm having said original shape configured to be non-linear as said at least one arm extends away from said core;

wherein said original shape of said at least one arm is a repeating series of bends as said arm extends away from said core; and wherein said series of said bends in said at least one arm are abrupt bends in alternating directions with each segment between said bends extending at least partially away from said core, such that said at least one arm exhibits a zig-zag radiating appearance.

2. A ball featuring resilient radiating arms, comprising:

a group of elongate arms radiating away from a central core;

said arms formed of a sufficiently resilient material that said arms can be deformed away from an original shape and later automatically return to said original shape when deforming loads are removed;

said arms each having a tip, said tips of said arms collectively defining portions of a peripheral contour of said ball;

said arms having a base spaced from said tip and adjacent said core, said bases of said arms held adjacent each other by a binder adjacent said central core, said binder separate from said resilient material forming said arms;

gaps located between said tips of said arms and spacing said tips of adjacent said arms away from each other, said gaps defining portions of said peripheral contour of said ball;

said gaps defining a greater amount of said peripheral contour than an amount of said peripheral contour defined by said tips of said arms;

wherein said tips of said arms are square in form;

wherein said arms have an original shape which is non-linear as said arms radiate away from said core;

wherein said original shape of said arms is a repeating series of bends; and wherein said series of said bends in said arms are abrupt bends in alternating directions with each segment between said bends extending at least partially away from said core, such hat said arms exhibit a zig-zag radiating appearance.

3. A ball featuring resilient radiating arms, comprising:

a group of elongate arms radiating away from a central core;

said arms formed of a sufficiently resilient material that said arms can be deformed away from an original shape and later automatically return to said original shape when deforming loads are removed;

said arms each having a tip, said tips of said arms collectively defining portions of a peripheral contour of said ball;

said arms having a base spaced from said tip and adjacent said core, said bases of said arms held adjacent each other by a binder adjacent said central core, said binder separate from said resilient material forming said arms;

gaps located between said tips of said arms and spacing said tips of adjacent said arms away from each other, said gaps defining portions of said peripheral contour of said ball;

said gaps defining a greater amount of said peripheral contour than an amount of said peripheral contour defined by said tips of said arms;

wherein said tips of said arms are square in form;

wherein said arms have an original shape which is non-linear as said arms radiate away from said core;

wherein said original shape of said arms is a repeating series of bends; and wherein said series of said bends in said arms are gradual bends in alternating directions, such that said arms exhibit a wavy contour as said arms extend away from said core.

4. A ball featuring resilient radiating arms, comprising:

a group of elongate arms radiating away from a central core;

said arms formed of a sufficient resilient material that said arms can be deformed away from an original shape and later automatically return to said original shape when deforming loads are removed;

said arms each having a tip, said tips of said arms collectively defining portions of a peripheral contour of said ball;

said arms having a base spaced from said tip and adjacent said core, said bases of said arms held adjacent each other by a binder adjacent said central core, said binder separate from said resilient material forming said arms;

gaps located between said tips of said arms and spacing said tips of adjacent said arms away from each other, said gaps defining portions of said peripheral contour of said ball;

said gaps defining a greater amount of said peripheral contour than an amount of said peripheral contour defined by said tips of said arms;

wherein each said base of each said arm is attached seamlessly together adjacent said core; and wherein each said arm is part of a sheet of said material with slits in said sheet dividing said sheet into said arms.

* * * * *